United States Patent [19]

Nomura et al.

[11] Patent Number: 5,023,110

[45] Date of Patent: Jun. 11, 1991

[54] PROCESS FOR PRODUCING ELECTRON EMISSION DEVICE

[75] Inventors: Ichiro Nomura, Yamato; Tetsuya Kaneko, Yokohama; Yoshikazu Banno, Atsugi; Toshihiko Takeda, Tokyo, all of Japan

[73] Assignee: Canon Kabushiki Kaisha, Tokyo, Japan

[21] Appl. No.: 345,173

[22] Filed: May 1, 1989

[30] Foreign Application Priority Data

May 2, 1988 [JP] Japan ..... 63-107570
May 2, 1988 [JP] Japan ..... 63-107571
Aug. 26, 1988 [JP] Japan ..... 63-210445

[51] Int. Cl.[5] ..... B05D 3/14

[52] U.S. Cl. ..... 427/49; 427/77; 427/78; 427/124; 427/125; 427/126.3; 427/255.2; 427/255.3; 427/294; 427/372.2; 427/383.1; 427/397.7

[58] Field of Search ..... 427/49, 372.2, 78, 77, 427/125, 124, 126.3, 255.3, 255.2, 294, 383.1, 397.7

[56] References Cited

U.S. PATENT DOCUMENTS 4,104,605 8/1978 Boudreaux et al. ..... 427/45.1 X
4,142,008 2/1979 Debolt ..... 427/45.1 X
4,242,805 1/1981 De Angelis ..... 427/45.1 X
4,292,344 9/1981 McHale ..... 427/45.1
4,306,897 12/1981 Maklad ..... 427/45.1 X

OTHER PUBLICATIONS

"The Emission of Hot Electrons and the Field Emission of Electrons from Tin Oxide", by M. I. Elinson et al., Radio Eng. Electron Physics, vol. 10, pp. 1290–1296, 1964.

"Electrical Conduction and Electron Emission of Discontinuous Thin Films", by G. Dittmer, Thin Solid Films, vol. 9, No. 3, pp. 317–328, Mar. 1972.

"Strong Electron Emission from Patterned Tin–Indium Oxide Thin Films", by M. Hartwell et al., 1975 International Electron Devices Meeting, pp. 519–521, Dec., 1975.

"Electroforming and Electron Emission of Carbon Thin Films", by H. Araki, Journal of Vacuum Society of Japan, vol. 26, No. 1, pp. 22–29, 1983.

*Primary Examiner*—Bernard Pianalto

*Attorney, Agent, or Firm*—Fitzpatrick, Cella, Harper & Scinto

[57] ABSTRACT

A process for producing an electron emission device having voltage controlled negative resistance (VCNR) characteristics. A conductive thin film containing fine particles of a metal, metal oxide, semiconductor or the like is formed on a substrate between opposing electrodes which are also form on the substrate. A voltage is applied across the conductive thin film to generate heat with which the conductive thin film is heat treated to have an island structure which is formed of a spatially discontinuous film of fine particles and which serves as an electron emitting region.

28 Claims, 5 Drawing Sheets

PROCESS FOR PRODUCING ELECTRON EMISSION DEVICE

BACKGROUND OF THE INVENTION

1. Field of the Invention

The present invention relates to an electron emission device and, more particularly to a process for producing an electron emission device of the surface conduction type.

2. Related Background Art

Devices capable of emitting electrons with simple constructions have been known, such as a cold cathode device which has been proposed by M. I. Elinson et al. in Radio Eng. Electron Phys., vol. 10, pp 1290–1296, 1965.

This device makes use of a phenomenon in which electrons are emitted from thin film of a small area formed on a substrate, when electric current is made to flow through the film in parallel with the surface of the film. Electron emission devices relying upon this phenomenon are generally referred to as surface conduction type electron emission device.

Various types of surface conduction electron emission device have been proposed. For instance, the above-mentioned device developed by M. I. Elinson makes use of a thin film of the $SnO_2(Sb)$. A device proposed by G. Dittmer (This Solid Film, Vol. 9, pp 317, 1972) uses an Au thin film, while a device proposed by M. Hartwell and C. G. Fonstad (IEEE Trans. ED Conf., pp 519, 1975) utilizes an ITO thin film. H. Araki et al (VACUUM. Vol. 26., No. 1. pp 22, 1983) proposes a device which incorporates a thin film of carbon.

FIG. 6 shows the construction of an example of such known electron emission devices of surface conduction type. The device has electrodes 1 and 2 for external electrical connection, a thin film 3 made of an electron emission material, and a substrate 5. An electron emitting region is denoted at 4.

Before put into use, a surface conduction type electron emission device is usually subjected to a heat treatment generally referred to as "electroforming" in which electric current is supplied to the device to form the electron emitting region. More specifically, a voltage is applied between the electrodes 1 and 2 so that electric current flow-through the thin film 3. As a result, the thin film 3 generates Joule heat which locally destructs, deforms or denaturates the thin film 3 so that a portion of the thin film 3 is changed to a state with a high electrical resistance and is formed to serve as the electron emitting portion 4, whereby an electron emitting function is obtained.

The state with high electrical resistance means a state in which minute cracks appears, generally ranging between 0.1 μm and 5 μm with structural discontinuity, i.e., so-called island structure, in these cracks. In such an island structure, fine particles of particle sizes ranging between several tens of Angstroms (Å) and several micro meters (μm) exist in a spatially discontinuous but electrically continuous state.

In operation, a voltage is applied between the electrodes 1 and 2 so that electrical current is supplied to the discontinuous film of high electrical resistance so as to flow in the surface region of the device, thereby causing the fine particles to emit electrons.

Thus, the known electron emission device has the electron emitting region 4 which is produced by the forming effected on the thin film 3 by heat generated as a result of a supply of electric current to the thin film 3. This known electron emission device suffers the following problems:

(1) Intentional design of the island structure is materially impossible, which makes it difficult to improve the device and causes a fluctuation in the quality of the device.

(2) Island structures are unstable and cannot withstand a long use. In addition, the device tends to be destroyed by external electromagnetic noise.

(3) The substrate tends to be damaged by large heat input incurred during execution of the forming process. This makes it difficult to produce a multi-staged device composed of a plurality of unit devices.

(4) Only materials having comparatively small work function, e.g., gold, silver, $SnO_2$ and ITO are usable as the island material, so that the device cannot produce a large output electrical current.

For these reasons, the surface conduction type electron emission devices, despite their simple construction, could not be satisfactorily put into industrial use.

SUMMARY OF THE INVENTION

In view of the above-described problems of the known surface conduction type electron emission devices, it is an object of the present invention to provide a novel process for producing a surface conduction type electron emission device which allows control of the operation characteristics of the product device, as well as control of the position of the electron emitting region on the device, while reducing fluctuation in the operation characteristics and offering product quality at least equivalent to that of known devices.

To this end, according to one aspect of the present invention, there is provided a process for producing an electron emission device comprising the steps of: forming a conductive thin film containing fine particles between opposing electrodes; and effecting a heat treatment on the conductive thin film by supplying electric current to the conductive thin film.

According to another aspect of the present invention, there is provided a process for producing an electron emission device comprising the steps of: forming a conductive thin film containing fine particles between opposing electrodes; and effecting a heat treatment on the conductive thin film by supplying electric current to the conductive thin film in such a manner as to impart a voltage controlled negative resistance characteristic to the conductive thin film.

DETAILED DESCRIPTION OF THE PREFERRED EMBODIMENTS

According to the present invention, a conductive thin film containing fine particles is placed between opposing electrodes and electrical current is supplied to the conductive thin film through these electrodes thereby effecting electrical heat-treatment (electroforming) on the conductive thin film so that a film having an island structure with structural discontinuity serving as an electron emitting region is formed.

More specifically, according to the present invention, a conductive thin film, which has been formed by dispersing fine particles in a binder or which is composed of fine particles, is formed between opposing electrodes and the thus formed conductive thin film is further heat-treated so as to form an electron emitting region. This feature is quite novel and significantly distinguishes the invention from known process for producing electron emission devices.

The fine particles may be dispersed between the electrodes by a suitable technique such as gas deposition, dispersion application, and so forth.

According to the present invention, the conductive thin film is heat-treated by the Joule heat generated as a result of supplying electric current thereto, so that a surface conduction type electron emission device having superior voltage controlled negative resistance (abbreviated as VCNR, hereinafter) characteristics can be obtained.

Namely, the conductive thin film containing fine particles is thermally decomposed as a result of heating by the supply of electric current so that spatially continuous and discontinuous portions are formed between the electrodes. This method reduces the amount of heat which is required in the forming process, i.e., heat-treatment for forming the electron emitting region, with the result that the risk that the film or the substrate will be cracked is reduced. Furthermore, controllability is improved because of the possibility of selecting the island material and because of the enhanced stability in the formation of the island structure.

In addition, the process of the present invention enables a control of VCNR characteristics by virtue of the 5 use of the conductive thin film containing fine particles. It is therefore possible to obtain a surface conduction type electron emission device having desired VCNR characteristic and enhanced output current.

Figure 1:
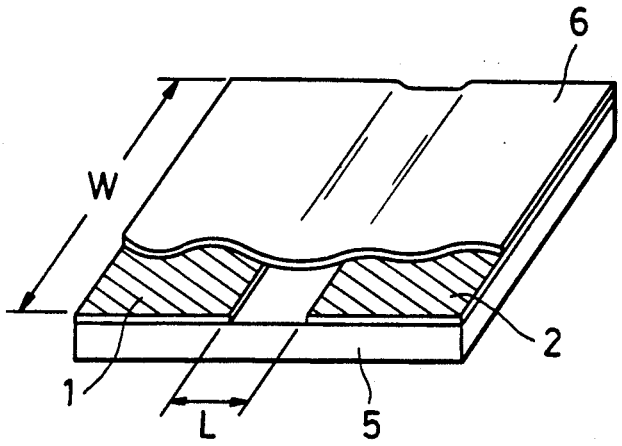
FIGS. 1A and 1B and FIGS. 2A and 2B are schematic illustrations of embodiments of a process of the invention for producing an electron emission device.
Figure 1:
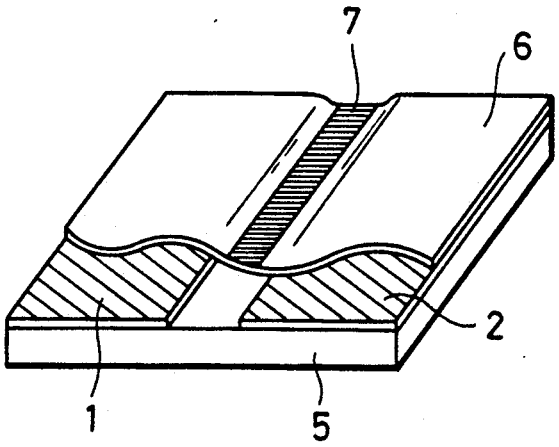
Figure 2:
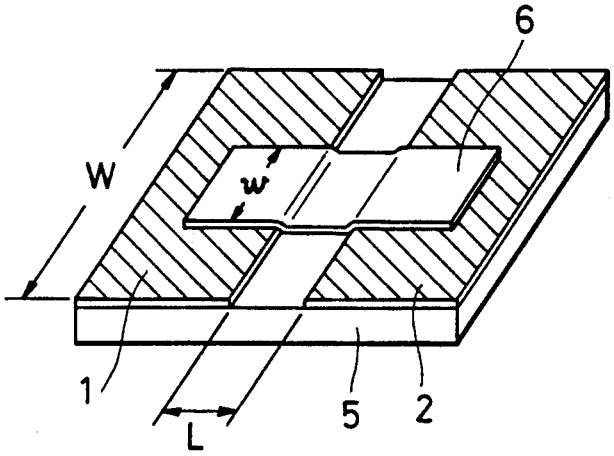
Figure 2:
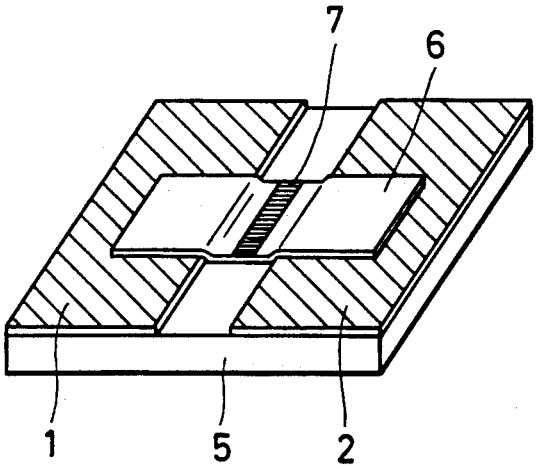

FIGS. 1B and 2B schematically show surface conduction type electron emission devices produced by a process in accordance with the present invention. In each of these devices, a conductive thin film 6 is provided between a pair of electrodes 1 and 2. The conductive thin film 6 has been heat-treated by heat produced as a result of supply of electric current to this conductive thin film so that at least a portion of this conductive thin film 6 has been changed to an electron emitting region 7. In operation, each device exhibits VCNR characteristics between the voltage applied and the output current.

In the device shown in FIG. 1B, the conductive thin film 6 is laid to cover the entire area of the electrodes 1 and 2, whereas, in the device shown in FIG. 2B, the conductive thin film 6 covers only selected portions of the electrodes 1 and 2. The arrangements shown in FIGS. 1B and 2B, however, are only illustrative. Namely, the configuration and other conditions of the conductive thin film 6 may be varied, as desired, provided that the conductive thin film 6 is electrically connected between the electrodes 1 and 2 and that at least a portion of the conductive thin film 6 has been changed into a spatially discontinuous state to provide an electron emitting region 7.

The process of the present invention will be described in detail hereinafter, with reference to FIGS. 1A, 1B and 2A, 2B.

Referring to FIGS. 1A and 2A, electrodes 1 and 2 and a conductive thin film 6 are laid on a substrate 5 which is made from an insulating material such as glass, quartz or the like.

The electrodes 1 and 2 are formed to oppose each other by a known technique such as a combination of vacuum film-forming process and photo-lithographic process. The electrodes 1 and 2 may be made from an ordinary conductive material such as a metal, e.g., Ni, Al, Cu, Au, Pt or Ag, an oxide, e.g., $SnO_2$ or ITO, or the like.

The thickness of the electrodes 1 and 2 preferably ranges between several hundreds of Angstroms (Å) and several micro meters (μm). The distance between the opposing electrodes 1 and 2 generally ranges between several hundreds of Angstroms (Å) and several tens of micro meters (μm), preferably between 1000Å and 10 μm.

The effect of the forming (heating by supply of electrical current) varies depending on factors such as the material of the fine particles, size of the particles and so forth. In general, however, a region of spatial discontinuity of particles is formed in the conductive thin film over at least the width W of the electrodes, provided that the electroforming is executed with the above-specified electrode spacing. If the distance between the electrodes 1 and 2 is greater than that specified above, the region of spatial particle discontinuity is formed only in a portion of the area over which the electrodes face each other. Conversely, when the distance between the electrodes 1 and 2 is smaller than that specified above, problems are caused such as degradation of the device due to breakdown of the electrodes at the time of the forming operation or breakdown of the electrodes and/or the region of spatial discontinuity during driving of the device.

The width W over which the electrodes oppose each other preferably ranges between several micron meters (μm) and several millimeters (mm).

The ranges specified above, however, should be understood as being standard values, and the invention may be carried out under conditions which do not fall within these ranges when the purpose of use of the product device or other factors permit the process to be executed under such conditions.

Materials which are suitably used as the material of the particles are ordinary cathode materials which have low levels of work function, as well as high melting points and low vapor pressure, materials which can be changed into electron emitting region 4 by conventional forming processes, or materials having a high efficiency of secondary electron emission. The particle size of the particles generally ranges between several tens of Angstroms (Å) and several micro meters (μm), preferably between several tens of Angstroms (Å) and several thousands of Angstroms (Å).

It is considered that the influence of the size of particles in the conductive thin film varies depending on other factors such as the material of the particles, material of the substrate, and the distance L between the electrodes. In general, however, particle size below the above-specified range tends to cause a large secular change of the device which may be attributable to movement of the particles in the device. On the other hand, when the particle size exceeds the above-specified range, the electron emitting region is formed only over a portion of the electrode width W.

According to the invention, the following substances are usable as the particle material, alone or in the form of a mixture of two or more of these substances: a boride such as $LaB_6$, $CeB_6$, $YB_4$ or $CdB_4$; a carbide such as TiC, ZrC, HfC, TaC, SiC or WC; a nitride such as TiN, ZrN or HfN; a metal such as Nb, Mo, Rh, Hf, Ta, W, Re, Ir, Pt, Ti, Au, Ag, u, Cr, Al, Co, Ni, Fe, Pb, Pd or Cs; a metal oxide such as $In_2O_3$, $SnO_2$ or $Sb_2O_3$; a semiconductor such as Si or Ge; and fine particles such as of carbon, Ag, Mg or the like.

The conductive thin film 6 containing the fine particles used in the invention is a film having a structure in the form of a continuous fine particle film in which the particles are distributed densely and having an electrical resistance on the order of several tens of kilo ohms (KΩ) per □ (sheet resistance). Preferably, the electrical resistance of the conductive film ranges between $1.0\times10^4$ Ω/□ and $2.0\times10^7$ Ω/□.

Electrical resistance values falling within the above-specified range allow a good forming operation.

When the electrical resistance is smaller than the above-specified range, problems such as thermal destruction of the substrate or deterioration of the conductive thin film 6 then to be caused due to excessive heat generation. Conversely, when the electrical resistance value exceeds the above-specified range, an impractically long time is required for the forming operation or the device tends to be damaged due to application of a high forming voltage which may become necessary to shorten the forming time.

No substantial problem is caused by any discontinuity of particles in this continuous particle film. The conductive thin film 6 may be formed on the substrate 5 after the formation of the opposing electrodes 1 and 2 or prior to the formation of these electrodes, provided that it can be stably and securely held between these electrodes. For instance, in the processes shown in FIGS. 1A and 2A, the conductive thin film 6 is formed after the formation of the electrodes 1 and 2 to overlay these electrodes 1 and 2.

The conductive thin film 6 may be formed by the following method, as well as by know techniques such as gas deposition or vacuum evaporation.

Fine particles of one of the above-mentioned substances, or particles of a compound containing such a substance, together with an additive or additives which may be added as required, are dispersed in an organic dispersion medium and the dispersion thus formed is stirred to obtain a uniform dispersion of the fine particles. The thus prepared dispersion of fine particles is then applied to the surface of the substrate 5 before or after the formation of the electrodes 1 and 2, by a suitable method such as dipping or spin-coating. Then, the dispersion medium is removed by evaporation. When the fine particles are prepared in the form of particles of a compound, firing is effected subsequently to the removal of the dispersion medium at a temperature and for a time high and long enough to cause the compound to be thermally composed.

It is thus possible to provide the conductive thin film 6 containing fine particles in the zone between the electrodes 1 and 2, i.e., in a zone marked by L in FIGS. 1A and 2A. When the conductive thin film 6 is formed after the formation of the electrodes 1 and 2, the conductive thin film 6 tends to overlie the areas other than the zone L. This, however, does not cause any problem because the portions of the conductive thin film 6 on these areas are materially free from the voltage applied between the electrodes 1 and 2.

Any organic dispersion medium capable of dispersing fine particles without denaturation of particles can be used in the present invention. For instance, butyl acetate, alcohol, methyl ethyl ketone, cyclohexane or a mixture thereof can be used suitably as the organic dispersion medium. Thus, the organic dispersion medium can be selected in accordance with the kind of fine particles.

The additive which may be used as desired is intended to promote the dispersion of the fine particles. For instance, dispersion assistants such as well known surfactants may be used as the additive.

The temperature and time of the firing mentioned above vary depending on factors such as the type of the organic dispersion medium used, amount of application of dispersion and so forth but are usually between 200° and 1000° C. and between 0.1 and 1.0 hour, respectively.

The solid content of the fine particle dispersion and the number of application cycles for applying the dispersion, i.e.,the amount of application, are controlled in accordance with the characteristics of the conductive thin film 6 to b formed, i.e., the characteristics of the electron emitting region 4 to be obtained. Namely, the solid content of the fine particle dispersion and the amount of application of the same can be determined such that the electrical resistance value of the conductive thin film to be formed falls within the range specified before. A too large solid content, as well as a too large amount of application, causes the electrical resistance value to be lowered, whereas a too small solid content, as well as a too small amount of application, causes the electrical resistance of the conductive thin film 6 to be increased excessively. In either case, it is difficult to obtain a surface conduction type electron emission device having excellent performance.

Use of gas deposition as the method for forming the conductive thin film 6 is preferred because it allows a wide selection of the material of fine particles, as well as a large controllability of the particle size.

According to the present invention, the electron emitting region 7 is formed as a result of the heat-treatment effected by the supply of electric current, i.e., forming, which causes the change of the structure of the conductive thin film 6 containing fine particles into an island structure in which particles exist in the form of discontinuous film. The electron emitting portion 7 may be spread over the entire portion of the conductive thin film 6 between both electrodes 1 and 2 or only over a portion of the same, as will be seen from FIGS. 1B and 2B.

The heat-treatment of the conductive thin film 6 by the supply of electric current, i.e., electroforming, may be effected in atmospheric air. From the view point to prevention of damage of the device, however, the heat-treatment is preferably executed in a vacuum or in an atmosphere of an inert gas. It is also preferred that the voltage applied during the heat-treatment is adjusted in accordance with the characteristics of the surface conduction type electron emission device to be obtained.

The heat-treatment with the supply of electric current requires a voltage above a certain threshold level, e.g., about 4 V or higher, although the threshold level varies depending on factors such as the material of the fine particle film and the shapes of the electrodes. In general, however, the heat-treatment is effected by applying a voltage which causes a voltage change of 1 V per minute, e.g., about 14 V. Application of a too high voltage, e.g., 15 V or higher, in a stepped manner may result in trouble such as destruction of the device and, therefore, should be avoided.

The surface conduction type electron emission device of the present invention thus produced essentially exhibits VCNR characteristics mentioned before, i.e., characteristics which reduce the current in response to a rise in the voltage applied.

Figure 3:
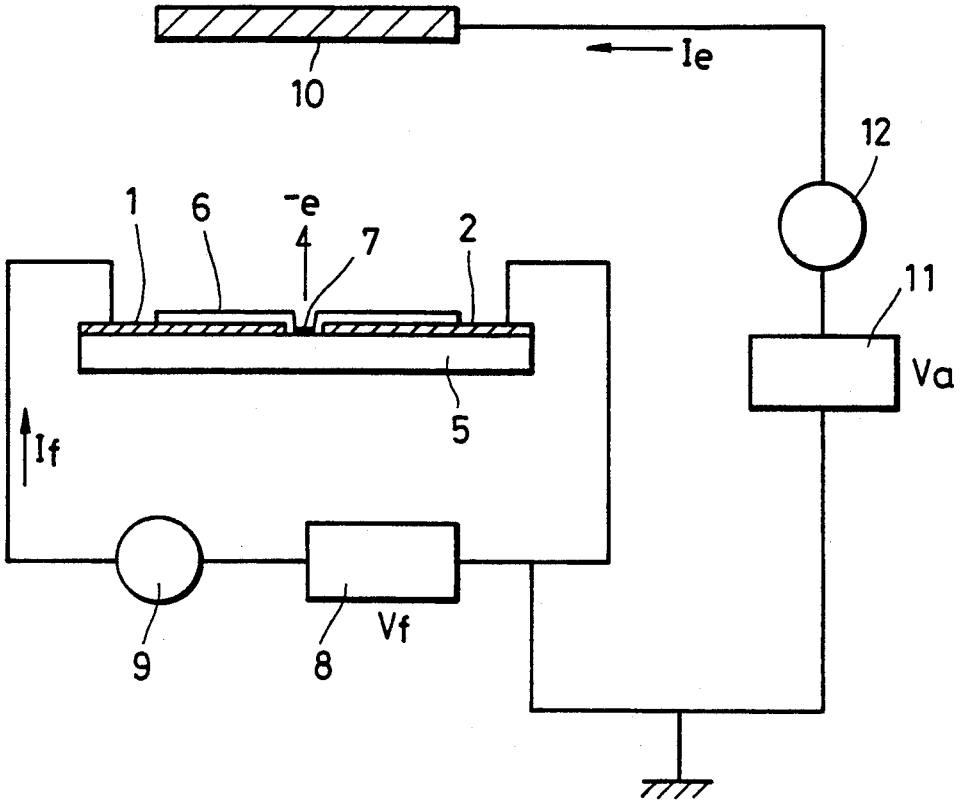
FIG. 3 is a schematic illustration of an apparatus for measuring the operation characteristics of an electron emission device produced by the process carrying out the invention.
Figure 6:
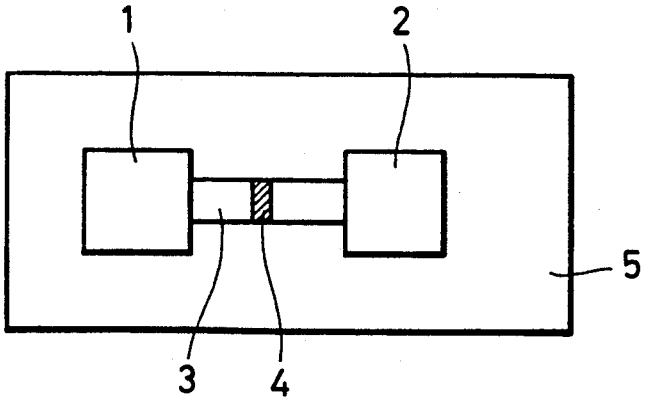
FIG. 6 is a schematic illustration of a known electron emission device.

A detailed description will now be given of the VCNR characteristics. FIG. 3 shows an apparatus which is suitably used for the purpose of measurement of the characteristics of a surface conduction type electron emission device produced by the process of the invention. The apparatus has a power supply 8 for applying a voltage to the electron emission device, an ammeter 9 for measuring the electric current flowing in the device, an anode 10 for measuring the electrons $-e$ emitted from the electron emission device, a power source 11 for applying a voltage to the anode 10, and an ammeter 12 for measuring the emitted electric current Ie. In this Figure, the same reference numerals are used to denote the same parts of the device as those in FIGS. 1A to 2B. In operation, a voltage Vf is applied to the surface conduction type electron emission device by from the power supply 8 so as to cause the device to emit electrons. Meanwhile, the electric current If flowing through the electron emission device is measured by the ammeter 9. At the same time, the emission current Ie is measured by the ammeter 12.

Figure 4:
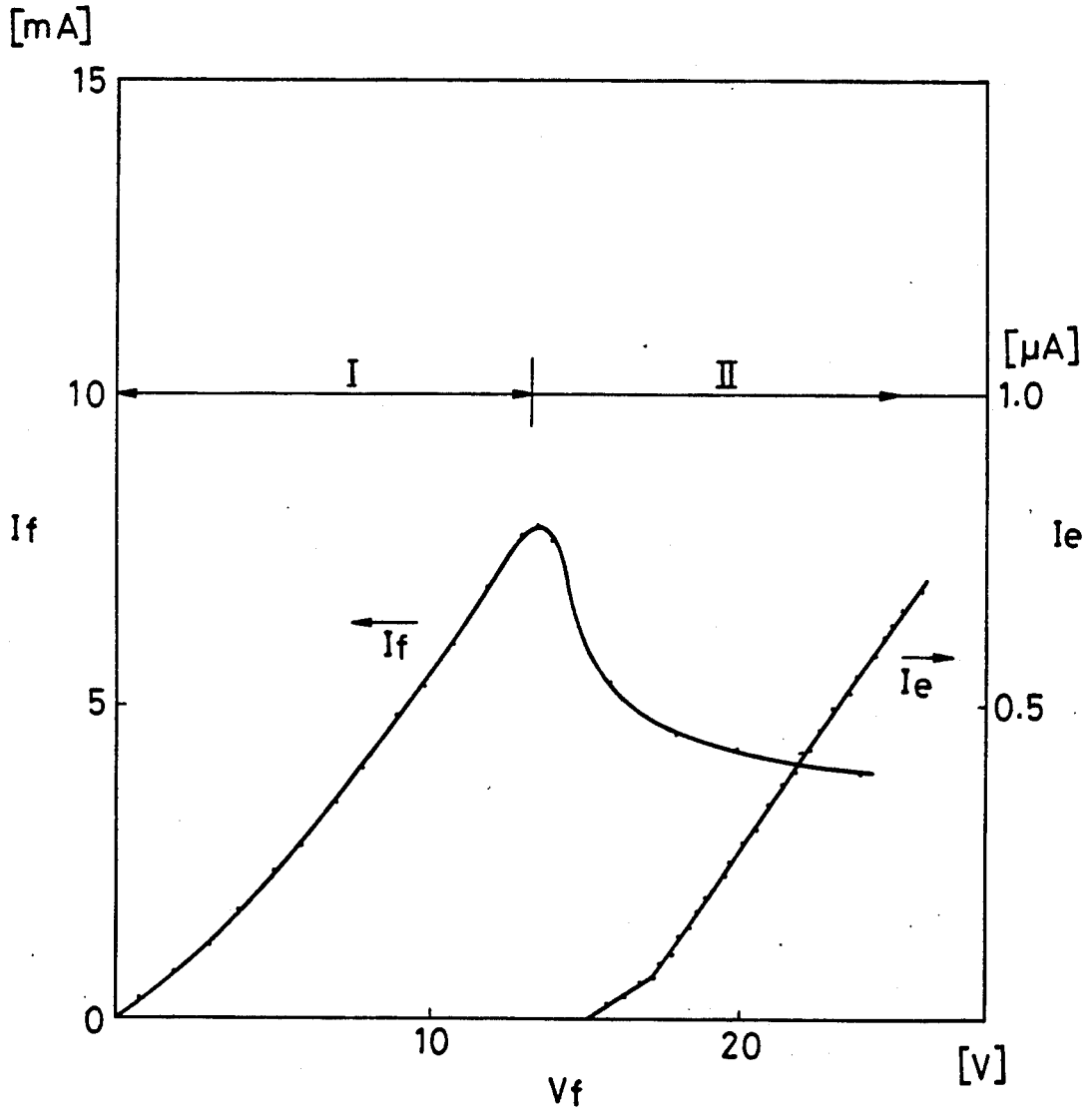
FIGS. 4 and 5 are graphs showing electron emission characteristics exhibited by electron emission devices produced by the process of the present invention.

The voltage Va applied by the power supply 11 may be suitably determined but in this measurement the voltage was fixed at 1000 V. During the measurement, the device was placed in a vacuum of $1\times10^{-5}$ Torr or greater. FIG. 4 shows, by way of example, the current-voltage characteristic (I-V characteristic) obtained with a surface conduction type electron emission device produced by the process of the invention. It will be seen that the I-V characteristic has a region I in which the current If in the device linearly increases in accordance with the increment in the voltage Vf applied to the device and a region II of voltage controlled negative resistance (VCNR) characteristics in which the current If decreases in accordance with a rise in the voltage Vf.

It will be understood that the device having the VCNR characteristic provides a large emission current Ie and, hence, a high electron emission efficiency Ie/If.

The VCNR characteristic is controllable through suitable selection and values of factors such as the distance L between the electrodes and the material of the fine particles.

The gradient of the VCNR characteristic can be evaluated in terms of the percentage (%) in the reduction of the electric current If in the electron emission device from the maximum value of the current If as observed when the voltage is increased by 3 V from the level corresponding to the maximum current If.

According to the present invention, the VCNR characteristic of the surface conduction type electron emission device is realized as a result of the formation of the electron emitting region 7 by the electrical heat-treatment, i.e., forming, of the conductive thin film 6 containing fine particles.

The mechanism by which the VCNR characteristic is developed, as well as the reason why the VCNR characteristic is controllable, has not been fully clarified yet. It is, however, understood that the realization of the VCNR characteristic and controllability of VCNR characteristic are attributable to the use of the conductive thin film containing fine particles and the forming process effected on such a conductive thin film by heat generated as a result of supply of electrical current to the conductive thin film.

As has been described, according to the present invention, a conductive thin film containing fine particles is disposed between opposing electrodes and heat-treatment (forming) is effected on the thin conductive film by heat generated as a result of the supply of electrical current to the conductive thin film so that a discontinuous film of fine particles is formed.

In consequence, the present invention offers the following advantages.

(1) It becomes possible to intentionally design the island structure and to remarkably reduce fluctuation of quality or performance of the device as compared with the known production processes.
(2) The island structure can withstand a longer use with stable emission of current.
(3) Risk that the film and the substrate will be cracked is reduced appreciably.
(4) Selection of material of the island structure is made possible.

EXAMPLES

EXAMPLE 1

A surface conduction type electron emission device having a construction as shown in FIG. 1B was produced by the following process. The electrode width W and the electrode spacing L were 200 μm and 10 μm, respectively.

A dispersion of fine particles was prepared by stirring a mixture of the following materials together with glass beads for 24 hours using a paint shaker.

1.0 g of fine particles $SnO_2$ (particle size 1000Å or smaller)

800 cc of organic dispersion medium

MEK (methyl ethyl ketone):cyclohexane=3:1

Ni electrodes 1 and 2 were formed by a vacuum film forming process and a photolithographic process on a quartz substrate 5 which had been sufficiently degreased and rinsed.

Then, the above-mentioned dispersion of fine particles was applied by spin a coating method on the surface of the substrate 5 and the substrate with the dispersion thus applied was fired at 250° C. for 10 minutes. The application of the dispersion and the firing were executed repeatedly so that a conductive thin film 6 containing fine particles and having electrical resistance of 150Ω or less was formed. The substrate with the conductive thin film formed thereon was then placed in a vacuum of $1\times10^{-5}$ Torr or igher and voltage was applied between the electrodes 1 and 2 with a voltage rising rate of 1 V/100 sec, i.e., at such a rate that voltage rises 1 V in 100 seconds, thereby heat-treating the conductive thin film 6 between the electrodes and 2 by the heat generated by the electrical current flowing through the conductive thin film 6, thus forming an electron emitting region 7.

The surface conduction type electron emission device thus formed exhibited VCNR characteristics, as well as excellent electron emission performance, and showed an I-V characteristic as shown in FIG. 4.

EXAMPLE 2

Figure 5:
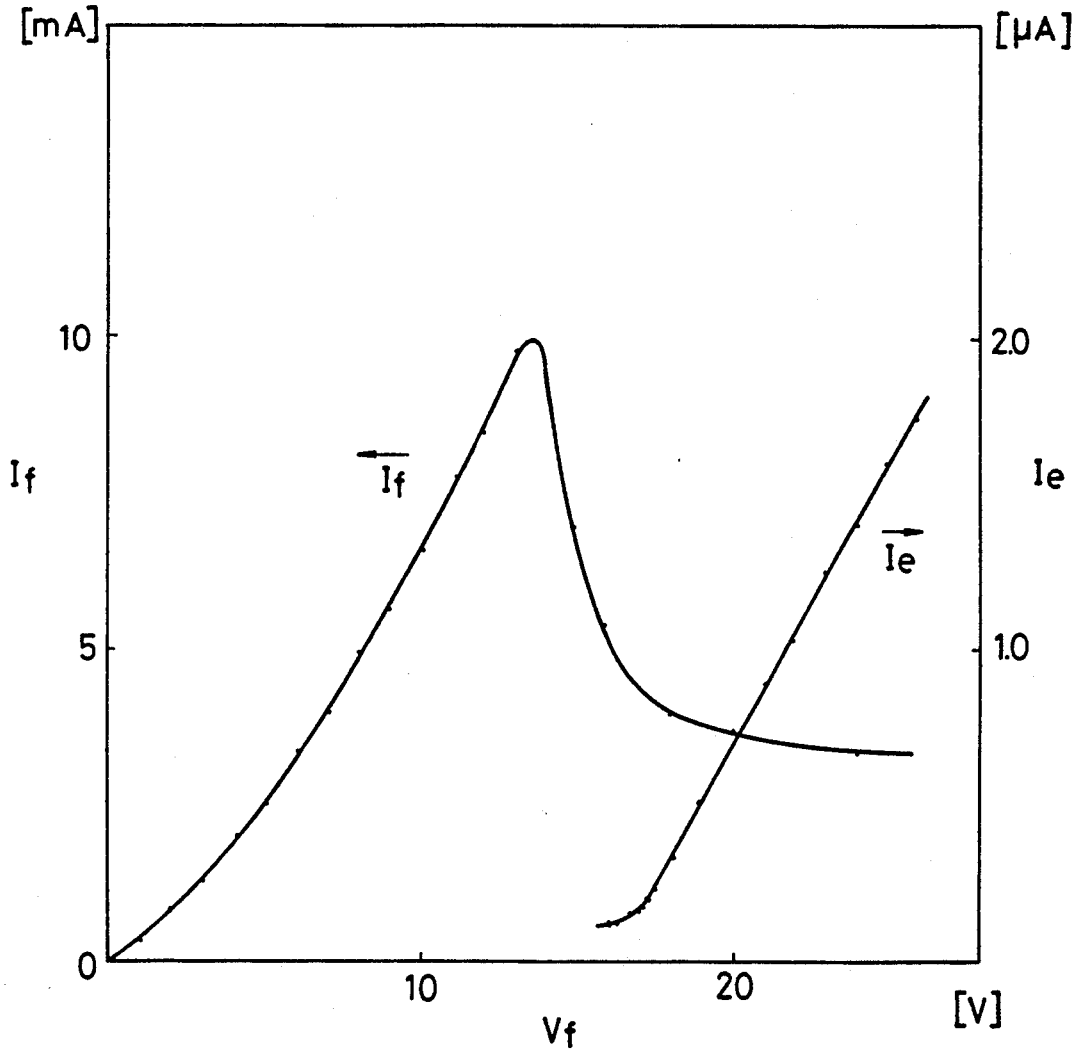

FIG. 5 is a graph showing the I-V characteristic as measured with a surface conduction type electron emission device of Example 2. This device was produced under the same condition as Example 1, except that the electrode width W and the electrode spacing L were changed to 200 μm and 5 μm, respectively.

From a comparison between FIGS. 4 and 5, it will be seen that the VCNR characteristic is controllable by changing the configuration of the device. More specifically, it was confirmed that the smaller electrode spacing L provides a greater gradient of the VCNR characteristic, with the emission current Ie and the electron emission efficiency Ie/If increased correspondingly.

EXAMPLE 3

Electrodes 1 and 2 were formed on a quartz substrate 5 in the same method as Example 1. The electrode width W and the electrode spacing L were changed to 10 μm and 5 μm, respectively.

Then, a conductive thin film 6 was formed with silver particles of a particle size not greater than 0.1 μm by a gas deposition process which is a well known method for forming films of ultra-fine particles and which is detailed in Powder and Industry Vol. 19, No. 5, 1987.

The gas deposition process enables formation of a film with extremely small particles having particle sizes of 0.1 μm or smaller such as of gold, copper nickel and various other metallic materials, as well as silver used in this Example.

The width of the conductive thin film 6 as measured in the direction parallel to the gap between the electrodes was 2 mm.

Then, heat-treatment was executed under a suitable condition by allowing electrical current to flow through the conductive thin film, whereby an electron emitting region 7 having an island structure composed of discontinuous film of silver particles was formed. This device showed good VCNR characteristics between the current and the voltage, as well as excellent electron emission performance.

EXAMPLE 4

A surface conduction type electron emission device was produced under the same condition as Example 1, except that a mixture of $SnO_2$ and Au, mixed at a ratio of Au:$SnO_2$=2:1 in terms of mole ratio, was used as the fine particles dispersed in the dispersion.

In this Example, $SnO_2$ particles contribute to the emission of electrons, while Au particles provide electrical conductivity between the electrodes.

The surface conduction type electron emission device of this Example suffers from minimum degradation during the forming process, because it exhibits a small electrical resistance in the state before the forming, thus allowing the forming voltage to be lowered to a level which does not destruct the device. In addition, the electron emission device of this Example could provide the same level of emission current with the device of Example 1 with a voltage which is lower than that applied to the device of Example 1, as will be understood from the following Table.

| Characteristics of Device | Emission Current | Drive Voltage |
|---|---|---|
| Example 1 | 1.0μA | 23V |
| Example 3 | 1.0μA | 20V |

What is claimed is:

1. A process for producing an electron emission device having opposing electrodes arranged on a substrate and an electron emitting region formed between said opposing electrodes, the forming of said electron emitting region comprising the steps of:

forming a conductive thin film containing fine particles of particle sizes ranging between several tens of Angstroms (Å) and several micrometers (μm) between the opposing electrodes; and effecting a heat treatment on said conductive thin film by supplying electric current to said conductive thin film.

2. A process according to claim 1, wherein the distance between the opposing electrodes ranges between 1000Å and 10 μm.

3. A process according to claim 1, wherein said conductive thin film containing said fine particles is formed to exhibit an electrical resistance ranging between $1.0\times10^4$ Ω/□ and $2.0\times10^7$ Ω/□ in terms of sheet resistance.

4. A process according to claim 1, wherein said conductive thin film is formed by a gas deposition technique or a dispersion application technique.

5. A process according to claim 1, wherein said heat treatment is effected by applying a total voltage of 4 V to 14 V across said conductive thin film.

6. A process according to claim 1, wherein said heat treatment is conducted in a vacuum or in an inert gas atmosphere.

7. A process for producing an electron emission device having opposing electrodes arranged on a substrate and an electron emitting region formed between said opposing electrodes, the forming of said electron emitting region comprising the steps of:

forming a conductive thin film containing fine particles of particle sizes ranging between several tens of Angstroms (Å) and several micrometers (μm) between the opposing electrodes; and effecting a heat treatment on said conductive thin film by supplying electric current to said conductive thin film to form a conductive thin film showing voltage controlled negative resistance characteristics between said electrodes.

8. A process according to claim 7, wherein the distance between the opposing electrodes ranges between 1000Å and 10 μm.

9. A process according to claim 7, wherein said conductive thin film containing said fine particles is formed to exhibit an electrical resistance ranging between $1.0\times10^4$ Ω/□ and $2.0\times10^7$ Ω/□ in terms of sheet resistance.

10. A process according to claim 7, wherein said conductive thin film is formed by gas a deposition technique or a dispersion application technique.

11. A process according to claim 7, wherein said heat treatment is effected by applying a total voltage of 4 V to 14 V across said conductive thin film.

12. A process according to claim 7, wherein said heat treatment is conducted in a vacuum or in an inert gas atmosphere.

13. A process for producing an electron emission device having opposing electrodes arranged on a substrate and an electron emitting region formed between said opposing electrodes, the forming of said electron emitting region comprising the steps of:

forming a conductive thin film containing fine particles of particle sizes ranging between several tens of Angstroms (Å) and several micrometers (μm) between the opposing electrodes; and effecting a heat treatment on said conductive thin film by supplying electric current to said conductive thin film, to form a conductive thin film spatially discontinuous and electrically connected, between said electrodes.

14. A process for producing an electron emission device having opposing electrodes arranged on a substrate and an electron emitting region formed between said opposing electrodes, the forming of said electron emitting region comprising the steps of:

forming a conductive thin film containing fine particles of particle sizes ranging between several tens of Angstroms (Å) and several micrometers (μm) between said electrodes; and effecting a heat treatment on said conductive thin film by supplying electric current to said conductive thin film, to form a conductive thin film spatially discontinuous and electrically connected and showing voltage controlled negative resistance characteristics, between said electrodes.

15. A process for producing an electron emission device having opposing electrodes arranged on a substrate and an electron emitting region formed between said opposing electrodes comprising the steps of:

forming a conductive thin film containing fine particles of particle sizes ranging between several tens of Angstroms (Å) and several micrometers (μm) between said electrodes; and supplying a voltage to said conductive thin film.

16. A process according to claim 15, wherein the distance between the opposing electrodes ranges between 1000Å and 10 μm.

17. A process according to claim 15, wherein said conductive thin film containing said fine particles is formed to exhibit an electrical resistance ranging between $1.0\times10^4$ Ω/□ and $2.0\times10^7$ Ω/□ in terms of sheet resistance.

18. A process according to claim 15, wherein said conductive thin film is formed by gas deposition technique or dispersion application technique.

19. A process according to claim 15, wherein said heat treatment is effected by applying a total voltage of 4 V to 14 V across said conductive thin film.

20. A process according to claim 15, wherein said supplying a voltage is conducted in a vacuum or in an inert gas atmosphere.

21. A process for producing an electron emission device having opposing electrodes arranged on a substrate and an electron emitting region formed between said opposing electrodes, the forming of said electron emitting region comprising the steps of:

forming a conductive thin film containing fine particles of particle sizes ranging between several tens of Angstroms (Å) and several micrometers (μm) between said electrodes; and supplying a voltage of said conductive thin film to form a conductive film showing voltage controlled negative resistance characteristics between said electrodes.

22. A process according to claim 21, wherein the distance between the opposing electrodes ranges between 1000Å and 10 μm.

23. A process according to claim 21, wherein said conductive thin film containing said fine particles is formed to exhibit an electrical resistance ranging between $1.0\times10^4$ Ω/□ and $2.0\times10^7$ Ω/□ in terms of sheet resistance.

24. A process according to claim 21, wherein said conductive thin film is formed by a gas deposition technique or a dispersion application technique.

25. A process according to claim 21, wherein said heat treatment is effected by applying a total voltage of 4 V to 14 V across said conductive thin film.

26. A process according to claim 21, wherein said supplying a voltage is conducted in a vacuum or in an inert gas atmosphere.

27. A process for producing an electron emission device having opposing electrodes arranged on a substrate and an electron emitting region formed between said opposing electrodes, the forming of said electron emitting region comprising the steps of:

forming a conductive thin film containing fine particles of particle sizes ranging between several tens of Angstroms (Å) and several micrometers (μm) between said electrodes; and supplying a voltage of said conductive thin film, to form a conductive thin film spatially discontinuous and electrically connected, between said electrodes.

28. A process for producing an electron emission device having opposing electrodes arranged on a substrate and an electron emitting region formed between said opposing electrodes, the forming of said electron emitting region comprising the steps of:

forming a conductive thin film containing fine particles of particle sizes ranging between several tens of Angstroms (Å) and several micrometers (μm) between said electrodes; and supplying a voltage of said conductive thin film, to form a conductive film spatially discontinuous and electrically connected and showing voltage controlled negative resistance characteristics, between said electrodes.

* * * * *

UNITED STATES PATENT AND TRADEMARK OFFICE

CERTIFICATE OF CORRECTION

PATENT NO. : 5,023,110

DATED : June 11, 1991

INVENTOR(S) : ICHIRO NOMURA ET AL.

It is certified that error appears in the above-identified patent and that said Letters Patent is hereby corrected as shown below:

AT [57] ABSTRACT

Line 6, "form" should read --formed--.

COLUMN 1

Line 16, "1965." should read --1964.--.
Line 28, "(This" should read --(Thin-- and
"Film," should read --Films,--.
Line 46, "flow-through" should read --flows through--.
Line 54, "appears," should read --appear,--.

COLUMN 3

Line 19, "process" should read --processes--.
Line 45, "5" should be deleted.

COLUMN 4

Line 46, "micron" should read --micro--.

COLUMN 5

Line 14, "u," should read --Cu,--.
Line 31, "then" should read --tend--.
Line 49, "know" should read --known--.

COLUMN 6

Line 31, "b" should read --be--.

UNITED STATES PATENT AND TRADEMARK OFFICE

CERTIFICATE OF CORRECTION

PATENT NO. : 5,023,110

DATED : June 11, 1991

INVENTOR(S) : ICHIRO NOMURA ET AL.

It is certified that error appears in the above-identified patent and that said Letters Patent is hereby corrected as shown below:

COLUMN 7

Line 42, "Fig. 4" should read --¶ Fig. 4--.

COLUMN 8

Line 33, "EXAMPLES" should be deleted.
Line 53, "spin a" should read --a spin--.
Line 61, "igher" should read --higher--.
Line 65, "and 2" should read --1 and 2--.

COLUMN 9

Line 33, "copper" should read --copper,--.

COLUMN 10

Line 61, "gas a" should read --a gas--.

UNITED STATES PATENT AND TRADEMARK OFFICE

CERTIFICATE OF CORRECTION

PATENT NO. : 5,023,110

DATED : June 11, 1991

INVENTOR(S) : ICHIRO NOMURA ET AL.

It is certified that error appears in the above-identified patent and that said Letters Patent is hereby corrected as shown below:

COLUMN 11

Line 48, "gas" should read --a gas--.
Line 49, "dispersion" should read --a dispersion--.

Signed and Sealed this

Sixteenth Day of February, 1993

*Attest:*

STEPHEN G. KUNIN

*Attesting Officer*

*Acting Commissioner of Patents and Trademarks*